US007883078B2

(12) United States Patent
Steffen

(10) Patent No.: US 7,883,078 B2
(45) Date of Patent: Feb. 8, 2011

(54) CAM CLAMP

(76) Inventor: Ted Steffen, c/o MP Components, 8499 Centre Industrial Dr., Byron Center, MI (US) 49315

( * ) Notice: Subject to any disclaimer, the term of this patent is extended or adjusted under 35 U.S.C. 154(b) by 72 days.

(21) Appl. No.: 11/969,553

(22) Filed: Jan. 4, 2008

(65) Prior Publication Data

US 2009/0174131 A1 Jul. 9, 2009

(51) Int. Cl.
*B25B 5/08* (2006.01)
*B25B 5/00* (2006.01)

(52) U.S. Cl. ..... 269/229; 269/254 CS; 269/66; 269/231

(58) Field of Classification Search ..... 269/229, 269/254 CS, 53, 66, 231
See application file for complete search history.

(56) References Cited

U.S. PATENT DOCUMENTS

| | | | | |
|---|---|---|---|---|
| 6,530,566 | B1 * | 3/2003 | DuVernay | 269/228 |
| 7,029,000 | B2 * | 4/2006 | Petit et al. | 269/47 |
| 7,168,693 | B1 * | 1/2007 | Sjuts et al. | 269/37 |
| 7,484,284 | B1 * | 2/2009 | Mason | 29/243.55 |
| 2009/0174131 | A1 * | 7/2009 | Steffen | 269/229 |

* cited by examiner

*Primary Examiner*—Lee D Wilson
(74) *Attorney, Agent, or Firm*—Robert J. SayFie

(57) ABSTRACT

A clamp having a first member and a second member; and a mechanism to linearly displace the first member and the second member away from, and toward each other in unison.

10 Claims, 3 Drawing Sheets

CAM CLAMP

BACKGROUND OF THE INVENTION

This invention relates to a clamp that can be opened and closed to check the integrity of clips. These clips may be used as fasteners, such as fasteners for interior parts of motor vehicles.

Before the present invention, such clips may be checked by using fixtures that do not open and close. Thus the clip is inserted, and manually removed from the fixture. Upon removal, the clip may be deformed, scratched, or sustain other damage.

As can be seen, there is a need for a clamp that can test clips without damage to the clip; and without damage to the clamp; so that the clamp may be re-used.

SUMMARY OF THE INVENTION

An aspect of the present invention is a clamp (10), comprising: a first member (90) and a second member (100); and a means to linearly displace said first member (90) and said second member (100) away from, and toward each other in unison.

Another aspect is a clamp (10), comprising: a housing (20) having a side (114); a base (130) secured immediately below and adjacent to said housing (20), said base (130) having a top side (132) extending inwardly with respect to said side (114) to define a channel therein; a first member (90) and a second member (100) slidably displaced within said channel; said first member (90) having a first member pin receiving aperture (95) therein, said second member (100) having a second member pin receiving aperture (105) therein; a guide pin (80) disposed at one end in said first member pin receiving aperture (95) and said guide pin (80) having another portion that is disposed in a neck (30) having a first cam (50); another guide pin (80) disposed at one end in said second member pin receiving aperture (105) and said other guide pin (80) having another portion that is disposed in said neck (30) having a second cam (60); a biasing device (120) to bias said first member (90) and said second member (100) away from each other, linearly, within said channel.

Yet another aspect is a method of opening and closing a clamp (10), comprising the steps of: rotating a first cam (50) and second cam (60) about a mutual axis; providing a means of transferring rotational displacement of said first cam (50) and second cam (60) into linear displacement of a first member (90) and a second member (100); whereby a first direction of rotation of said first cam (50) and said second cam (60) simultaneously linearly displaces said first member (90) and said second member (100) in a first linear direction, and a second direction of rotation of said first cam (50) and said second cam (60) simultaneously linearly displaces said first member (90) and said second member (100) in a second linear direction.

These and other features, aspects and advantages of the present invention will become better understood with reference to the following drawings, description and claims.

REFERENCE NUMERALS

Figure 4:
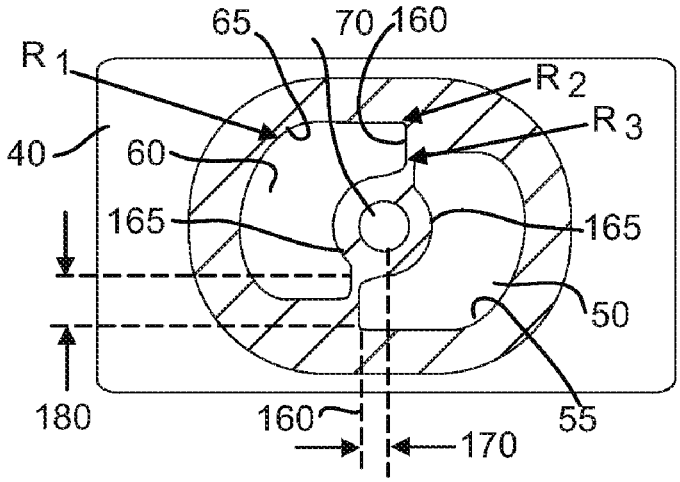
FIG. 4 is a pictorial mirror image cross sectional view along the line D-D of FIG. 1.

10 clamp
20 housing
30 neck
40 handle
50 first cam
55 first cam wall
60 second cam
65 second cam wall
70 pivot pin
75 pivot pin securing device
80 guide pin
90 first member
95 first member pin receiving aperture
100 second member
105 second member pin receiving aperture
110 cut-out
114 side
120 biasing device
125 biasing device aperture
130 base
132 top face
140 first clamp portion
150 second clamp portion
160 flat
165 circular portion of the cam
170 distance
180 second distance
X distance along the X axis of FIG. 4
Y distance along the Y axis of FIG. 4
$R_1$ first radii
$R_2$ second radii
$R_3$ third radii

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
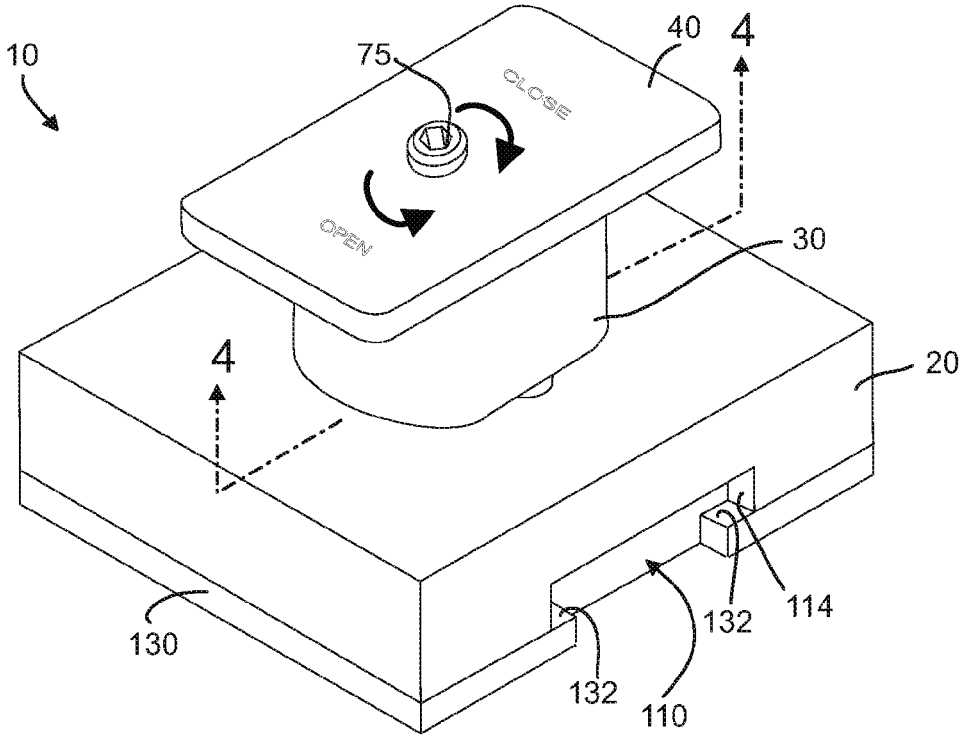
FIG. 1 is a pictorial view of an exemplary embodiment of the present invention.
Figure 3:
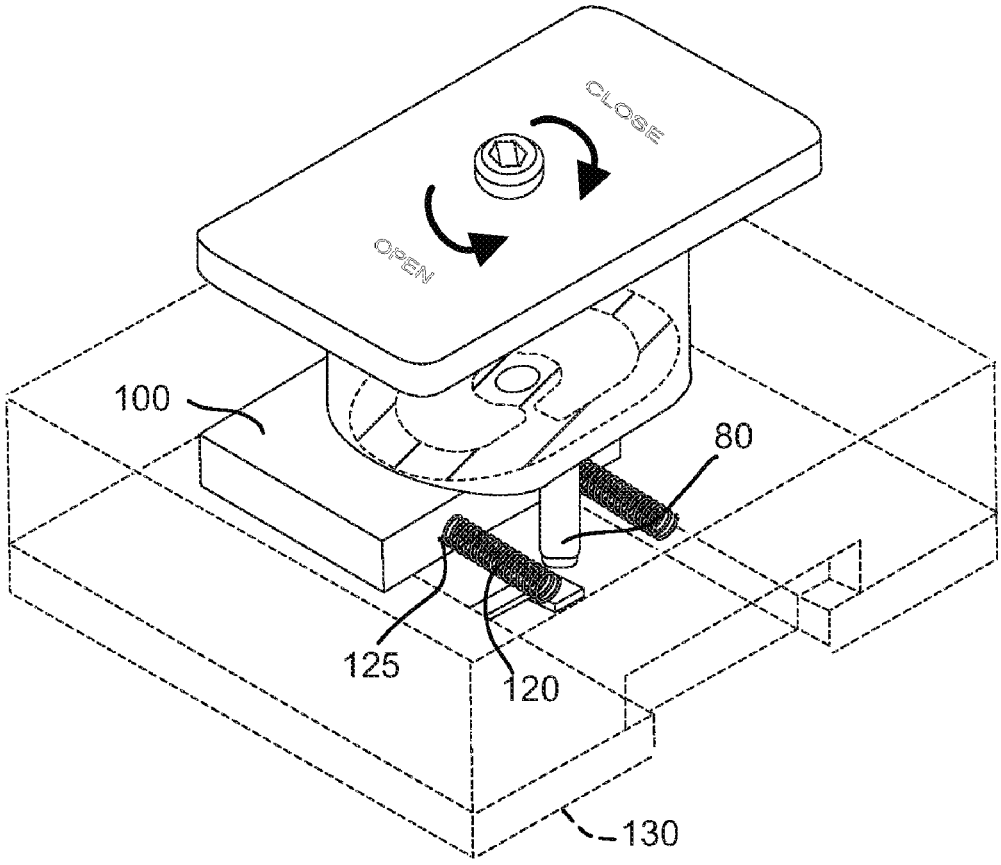
FIG. 3 is a partial "see through" pictorial view of an exemplary embodiment of a clip portion of the present invention.
Figure 6:
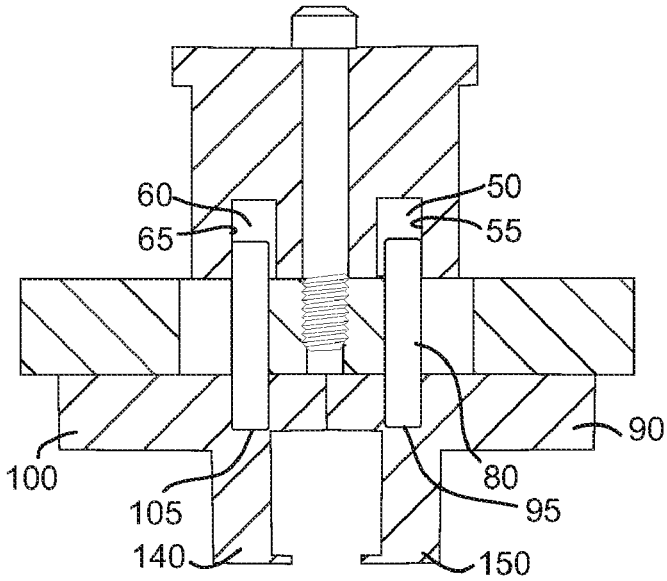
FIG. 6 is a cross sectional view of an exemplary embodiment of the present invention along the line B-B of FIG. 2.

FIG. 1 illustrates an exemplary embodiment of the present invention, referred to as a clamp 10. In general, the clamp 10 is operated by turning or angularly displacing or rotating a handle 40 that is connected to a neck 30. The neck may contain a first cam 50 and second cam 60 (as seen in FIG. 4) having guide pins 80 (as seen in FIGS. 3 and 6) therein. Thus, as seen in FIG. 6, one guide pin 80 may have one end or portion that is disposed in a respective first cam 50, and an opposed end or portion that may be disposed in a first member pin receiving aperture 95. Similarly, another guide pin 80 may have one end or portion that is disposed in a second cam 60, and an opposed end or portion that is disposed in a second member pin receiving aperture 105. The first member pin receiving aperture 95 is in a first member 90. The second member pin receiving aperture 105 is in a second member 105. The first member 90 and second member 100 each may have a respective biasing device aperture 125 to receive a biasing device 120 therein. The biasing device 120 may exert a biasing force to bias the first member 90 and second member 100 away from each other. This biasing force may be linear.

In one exemplary embodiment, the biasing device 120 may be a spring 120, as illustrated in FIG. 3. Thus when the handle 40 is turned about an axis, such as a pivot pin 70, the first cam 50 and second cam 60 may be angularly displaced about the axis, such as that created by a pivot pin 70. The biasing force, may force the first member 90 and second member 100 away from each other 100, 90, and thus force a portion of one guide pin 80 to follow a first cam wall 55 and another guide pin 80 to follow a second cam wall 65. As one end or one portion of one guide pin 80 is also received by a first member receiving aperture 95 and another guide pin is received by a second member receiving aperture 105, this may enable the respective first member 90 and second member 100 to be linearly displaced in unison away and toward each respective first member 90 and second member 100, depending on the rotation of the cams 50, 60; or, in other words, dependent on the rotation of the handle 40.

FIG. 1 further illustrates a housing 20 having a cut-out 110. The first member 90 and second member 100 may be capable of being linearly displaced with respect to the housing 20, which may remain stationary relative to the linear displacement of the first member 90 and second member 100. A base 30 may be disposed immediately adjacent and below the housing 20. The base 30 may have a top face 132 that extends inwardly from a side 114 of the housing. An interface of the side 114 and the top face 132 creates a channel, in which the first member 90 and second member 100 may be slidably or linearly moveably within.

Figure 2:
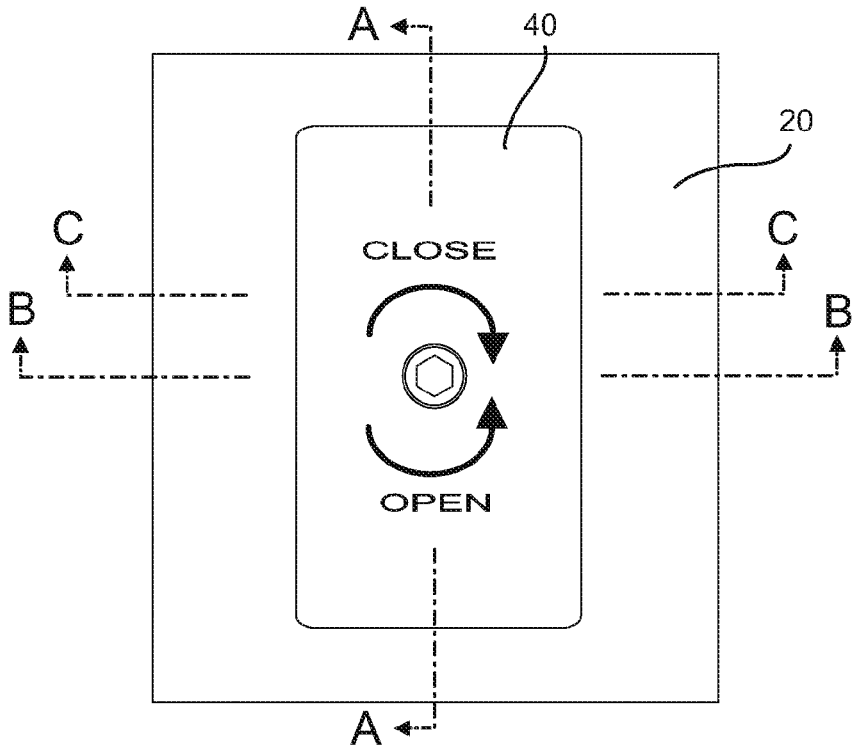
FIG. 2 is a top view of an exemplary embodiment of the present invention.
Figure 5:
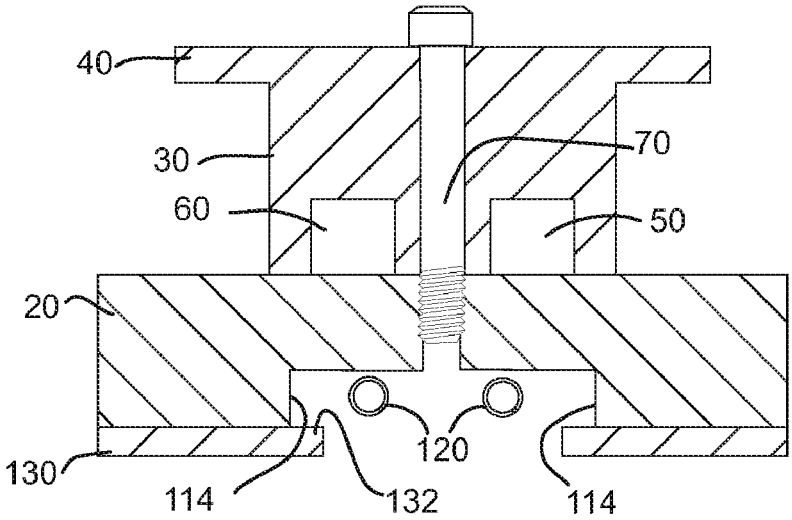
FIG. 5 is a cross sectional view of an exemplary embodiment of the present invention along the line A-A of FIG. 2.

FIG. 5 illustrates many of the above referenced components in a cross sectional view along the line A-A from FIG. 2.

Figure 7:
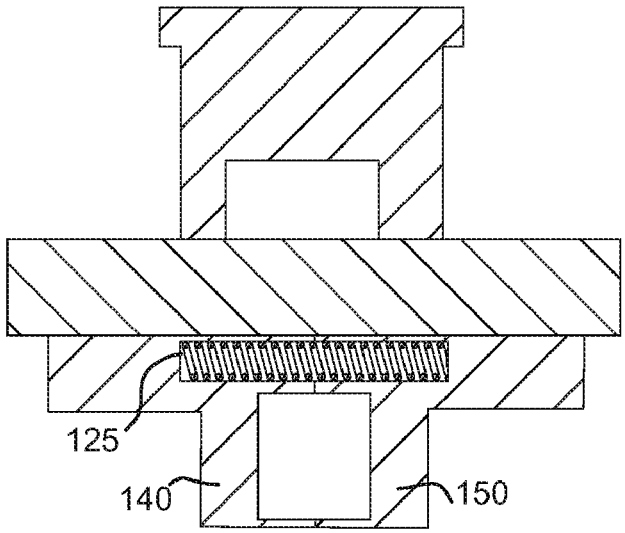
FIG. 7 is a cross sectional view of an exemplary embodiment of the present invention along the line C-C of FIG. 2.

FIG. 6 illustrates the guide pins 80 and their extension from the first cam 50 and second cam 60 respectively, downwardly into the first member 90 and second member 100 respectively. A first clamp portion 140 and second clamp portion 150 are also illustrated in the "open" position. The clamp portions 140, 150 are referred to as "open" because they are not touching. When the clamp portions 140, 150 are touching, they are in the "closed" position. FIG. 7 illustrates the first clamp portion 140 and the second clamp portion 150 in the closed position. In use, the clamp 10 may be in the closed position, then the clip or workpiece may be inserted therein. Then the clamp 10 may be opened by turning the handle 40, so that the first clamp portion 140 and the second clamp portion 150 are displaced away from each other, so the clip or workpiece may be removed.

The dimensions and sized of the clamp 10 and its elements or components may vary. For example, as illustrated in FIG. 4, "Y" is shown to illustrate a distance along the Y axis as shown in FIG. 4, of the distance from the first cam wall 55 to the second cam wall 65. And "X" is shown to illustrate a distance along the X axis as shown in FIG. 4, of the distance from the first cam wall 55 to the second cam wall 65. These distances may vary. FIG. 4 also illustrates a first radii $R_1$, which may be equal to Y/2. A second radii $R_2$ may be smaller than a radii of the guide pin 80. A third radii $R_3$ may be small enough to allow the guide pin 80 to contact the flat 160. In one exemplary embodiment of the present invention, the difference between X and Y is the combined travel of the first clamp portion 140 and the second clamp portion 150. The distance between the axis of rotation of the pivot pin 70 and the flat 160 is referenced as distance 170. The distance 170 may be equal to the radii of the guide pin 80. A second distance 180 of the face 160 may be greater than the diameter of the guide pin 80. The second distance 180 may also be measured from a cam circular portion 165 (or circular portion of the cam 165) to the nearest contiguous first or second cam wall 55, 65. The circular portion of the cam 165 may be substantially concentric with the pivot pin 70. However, in other exemplary embodiments of the present invention, these dimensions, and ratios may vary.

Also, although the cams 50, 60, are used with guide pins 80, to change the rotational direction of the cams 50, 60 to linearly displace the members 90, 100, other means to transfer rotational displacement into linear displacement may be used. This is referred to herein as a means to transfer a rotational direction of said first cam 50 into a linear direction of said member 90.

The materials of which the elements are made may vary. The clamp's 10 various components may be constructed from metals, composites, plastics, glass, or woods, or a combination of the aforesaid materials. Other components may be added to improve on functions. For example, ball bearings may be used to aid in the motion of surfaces or components.

Also, the movements and displacements herein may be performed manually, robotically, or by other means.

It should be understood, of course, that the foregoing relates to exemplary embodiments of the invention and that modifications may be made without departing from the spirit and scope of the invention as set forth in the following claims.

I claim:

1. A clamp (10), comprising:

a first member (90) and a second member (100); and a means to linearly displace said first member (90) and said second member (100) away from, and toward each other in unison wherein said means to linearly displace include a base (130) secured immediately below and adjacent to said housing (20), said base (130) having a top side (132) extending inwardly with respect to said side (114) to define a channel therein;

said first member (90) and said second member (100) slidably displaced within said channel; said first member (90) having a first member pin receiving aperture (95) therein, said second member (100) having a second member pin receiving aperture (105) therein;

a guide pin (80) disposed at one end in said first member pin receiving aperture (95) and said guide pin (80) having another portion that is disposed in a first cam (50) of a neck (30);

another guide pin (80) disposed at one end in said second member pin receiving aperture (105) and said other guide pin (80) having another portion that is disposed a second cam (60) in a neck (30); and a biasing device (120) to bias said first member (90) and said second member (100) away from each other, linearly, within said channel.

2. The clamp (10) of claim 1, wherein a first direction of rotation of said first cam (50) and said second cam (60) simultaneously linearly displaces said first member (90) and said second member (100) in a first linear direction, and a second direction of rotation of said first cam (50) and said second cam (60) simultaneously linearly displaces said first member (90) and said second member (100) in a second linear direction.

3. The clamp (10) of claim 2, wherein:

said rotation of said first cam (50) and said second cam (60) is performed by a means of rotation.

4. The clamp (10) of claim 3, wherein said means of rotation include said neck (30) having an axis of rotation, and further comprising:

said first cam (50) having a first cam wall (55) and a contiguous face (160);

said second cam (60) having a second cam wall (65) and a contiguous face (160);

a distance (Y) from said first cam wall (55) to said second cam wall (65) along the Y axis;

a distance (X) from said first cam wall (55) to said second cam wall (65) along the X axis;

a distance (170) from the axis of rotation to the face (160);

a first radii ($R_1$) of said first cam wall (55) and of said second cam wall (65);

said first cam wall (55) and said face (160) forming a second radii ($R_2$);

said second cam wall (65) and said face (160) forming a second radii ($R_2$); and a circular portion (165) of the first and second cam (50, 60) contiguous with said face (160), and contiguous with each respective said first cam wall (55) and said second cam wall (65);

whereby said face (160) has a radii ($R_3$) that allows said guide pin (80) to contact said flat (160), said first radii ($R_1$) equals Y divided by 2, a distance (180) from the circular portion (165) to the nearest contiguous first and second cam wall (55, 65) is greater than a diameter of said guide pin (80), said second radii ($R_2$) is less than that of said guide pin (80), said distance (170) is greater than the radii of said guide pin (80), and the difference between the X distance and the Y distance is the combined travel of both said first member (90) and said second member (100).

5. The clamp (10) of claim 4, wherein said axis of rotation is concentric with a pivot pin (70).

6. A clamp (10), comprising:

a housing (20) having a side (114);

a base (130) secured immediately below and adjacent to said housing (20), said base (130) having a top side (132) extending inwardly with respect to said side (114) to define a channel therein;

a first member (90) and a second member (100) slidably displaced within said channel; said first member (90) having a first member pin receiving aperture (95) therein, said second member (100) having a second member pin receiving aperture (105) therein;

a guide pin (80) disposed at one end in said first member pin receiving aperture (95) and said guide pin (80) having another portion that is disposed in a neck (30) having a first cam (50);

another guide pin (80) disposed at one end in said second member pin receiving aperture (105) and said other guide pin (80) having another portion that is disposed in said neck (30) having a second cam (60);

a biasing device (120) to bias said first member (90) and said second member (100) away from each other, linearly, within said channel.

7. The clamp (10) of claim 6, wherein a first direction of rotation of said first cam (50) and said second cam (60) simultaneously linearly displaces said first member (90) and said second member (100) in a first linear direction, and a second direction of rotation of said first cam (50) and said second cam (60) simultaneously linearly displaces said first member (90) and said second member (100) in a second linear direction.

8. The clamp (10) of claim 6, wherein:

said rotation of said first cam (50) and said second cam (60) is performed by a means of rotation.

9. The clamp (10) of claim 8, wherein said means of rotation include said neck (30) having an axis of rotation, and further comprising:

said first cam (50) having a first cam wall (55) and a contiguous face (160);

said second cam (60) having a second cam wall (65) and a contiguous face (160);

a distance (Y) from said first cam wall (55) to said second cam wall (65) along the Y axis;

a distance (X) from said first cam wall (55) to said second cam wall (65) along the X axis;

a distance (170) from the axis of rotation to the face (160);

a first radii ($R_1$) of said first cam wall (55) and of said second cam wall (65);

said first cam wall (55) and said face (160) forming a second radii ($R_2$);

said second cam wall (65) and said face (160) forming a second radii ($R_2$); and a circular portion (165) of the first and second cam (50, 60) contiguous with said face (160), and contiguous with each respective said first cam wall (55) and said second cam wall (65);

whereby said face (160) has a radii ($R_3$) that allows said guide pin (80) to contact said flat (160), said first radii ($R_1$) equals Y divided by 2, a distance (180) from the circular portion (165) to the nearest contiguous first and second cam wall (55, 65) is greater than a diameter of said guide pin (80), said second radii ($R_2$) is less than that of said guide pin (80), said distance (170) is greater than the radii of said guide pin (80), and the difference between the X distance and the Y distance is the combined travel of both said first member (90) and said second member (100).

10. The clamp (10) of claim 9, wherein said axis of rotation is concentric with a pivot pin (70).

* * * * *